US009266322B2

(12) United States Patent
Ozawa

(10) Patent No.: US 9,266,322 B2
(45) Date of Patent: Feb. 23, 2016

(54) LIQUID EJECTING APPARATUS AND METHOD OF CONTROLLING LIQUID EJECTING APPARATUS

(71) Applicant: Seiko Epson Corporation, Tokyo (JP)

(72) Inventor: Kinya Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/325,327

(22) Filed: Jul. 7, 2014

(65) Prior Publication Data

US 2015/0015630 A1 Jan. 15, 2015

(30) Foreign Application Priority Data

Jul. 9, 2013 (JP) ..... 2013-143290

(51) Int. Cl.
*B41J 29/38* (2006.01)
*B41J 2/045* (2006.01)

(52) U.S. Cl.
CPC ..... *B41J 2/04563* (2013.01); *B41J 2/04573* (2013.01); *B41J 2/04581* (2013.01); *B41J 2/04588* (2013.01)

(58) Field of Classification Search
CPC .. B41J 2/0454; B41J 2/04541; B41J 2/04553; B41J 2/04563; B41J 2/04571; B41J 2/04581; B41J 2/04588; B41J 2/459; B41J 2/04591
USPC ..... 347/5, 6, 9–12, 14, 17, 19, 56, 57, 347/68–72, 47
See application file for complete search history.

(56) References Cited

U.S. PATENT DOCUMENTS 8,562,094 B2 * 10/2013 Ozawa et al. ..... 347/10
2009/0174735 A1 * 7/2009 Yamada ..... 347/7
2011/0249053 A1 * 10/2011 Makita et al. ..... 347/17

FOREIGN PATENT DOCUMENTS

JP 2010-221670 A 10/2010

* cited by examiner

*Primary Examiner* — Hai C Pham
(74) *Attorney, Agent, or Firm* — Kilpatrick Townsend & Stockton LLP

(57) ABSTRACT

Disclosed is a liquid ejecting apparatus, and a method of controlling the liquid ejecting apparatus, whereby at a timing at which temperature detection and ejection pulse change are subsequently performed, a frequency of execution of temperature detection and driving pulse change differs according to whether temperature detected by the temperature sensor is in a first temperature range in which a degree of change in viscosity of ink for change in temperature is relatively high or in a second temperature range in which the degree of the change in viscosity for the change in temperature is relative stable. More specifically, in the first temperature range, the frequency of execution of temperature detection and driving pulse change is high compared to the second temperature range.

8 Claims, 8 Drawing Sheets

LIQUID EJECTING APPARATUS AND METHOD OF CONTROLLING LIQUID EJECTING APPARATUS

This application claims priority to Japanese Application No. 2013-143290, filed on Jul. 9, 2013, the entirety of which is incorporated by reference herein.

BACKGROUND

1. Technical Field

The present invention relates to a liquid ejecting apparatus, such as an ink jet type recording apparatus, and a method of controlling the liquid ejecting apparatus, and, in particular, to a liquid ejecting apparatus that ejects liquid from nozzles by driving a pressure generation section in such a way as to apply a driving waveform included in a driving signal to the pressure generation section and by generating pressure variation in liquid within pressure chambers which communicate with the nozzles, and a method of controlling the liquid ejecting apparatus.

2. Related Art

A liquid ejecting apparatus is an apparatus which includes a liquid ejecting head and ejects (discharges) various types of liquid from the liquid ejecting head. The liquid ejecting apparatus includes, for example, an image recording apparatus, such as an ink jet type printer (hereinafter, simply referred to as a printer) or an ink jet type plotter. In recent years, the liquid ejecting apparatus has been applied to various types of manufacturing apparatuses with emphasis on a feature in which it is possible to cause a negligible tiny amount of liquid to accurately land on a specific position. The liquid ejecting apparatus is applied to, for example, a display manufacturing apparatus which manufactures the color filters of a liquid crystal display or the like, an electrode forming apparatus which forms electrodes of an organic Electro Luminescence (EL) display, a Field Emission Display (FED), or the like, and a chip manufacturing apparatus which manufactures a biochip (biochemical element). Further, a recording head for the image recording apparatus ejects fluid ink, and a color material ejecting head for the display manufacturing apparatus ejects the solutions of respective color materials of Red (R), Green (G), and Blue (B). In addition, an electrode material ejecting head for the electrode forming apparatus ejects fluid electrode materials, and a bio organic matter ejecting head for the chip manufacturing apparatus ejects the solution of a bio organic matter.

An ink jet type recording head (one kind of a liquid ejecting head. Hereinafter, simply referred to as a recording head), which is mounted on the above-described printer, includes nozzle rows (nozzle groups) in which nozzles for ejecting ink are provided in a plurality of rows, and, for example, a piezoelectric element, a heating element, an electrostatic actuator or the like as a pressure generation section which ejects ink from the nozzles by generating pressure variation in ink within pressure chambers which communicate with the nozzles. Further, the printer is configured to eject ink by driving the pressure generation section in such a way as to apply a driving pulse, which is generated by a driving signal generation section, to the pressure generation section.

Here, in recent years, there is a case in which the printer is used for the purpose of printing a recording medium, which is larger than a recording medium, such as printing paper used in a general home printer, for example, outdoor advertisement. For example, a resin film which is formed of vinyl chloride, or a film which is acquired by coating or laminating polyester fiber woven fabric called tarpaulin using synthetic resin is used as the recording medium in this case with emphasis on weather resistance. Further, there is a case in which ink including thermoplastic resin particles (hereinafter, referred to as resin ink) are used as ink which is used to perform printing and recording on the recording medium (for example, refer to JP-A-2010-221670). When the resin ink hardens on the recording medium, a strong resin film is formed, with the result that the resin ink is excellent in abrasion resistance and weather resistance compared to water-based ink, and thus the resin ink is suitable for printing of outdoor advertisements or the like.

However, when an image or the like is recorded by ejecting resin ink to a hydrophobic recording medium, such as the resin film, the resin ink which lands on the recording medium should be rapidly solidified and fixed, and thus a configuration has been proposed in which a heating section (platen heater) that heats the recording medium on a platen is provided, and in which the ink that lands on the recording medium is promoted to be dried and fixed by heating the recording paper using the heating section.

In the above configuration in which the recording medium is heated using the heating section, heat from the heating section is transmitted to the recording head, and thus the viscosity of ink is changed as time elapses. Generally, the viscosity of ink is lowered as temperature in the recording head rises. When the viscosity of ink is lowered, the amount of ink (weight and volume) which is ejected using the same pressure increases. That is, ejection characteristics vary according to temperature. Therefore, in a printer according to the related art, a configuration has been proposed in which a temperature detection section, such as a thermistor, is provided in the vicinity of the inside or the outside of a recording head and in which ejection characteristics are uniformly maintained regardless of temperature by changing a driving pulse according to detected temperature. However, if temperature detection and driving pulse correction are frequently performed during a printing process, there is a problem in that the throughput of the entire printing process is lowered because the processing function of the control unit of the printer is caused to be lowered.

The problem is not limited to a printer that ejects ink and exists in a liquid ejecting apparatus that ejects liquid which has relatively large change in viscosity with regard to temperature in the same manner.

SUMMARY

An advantage of some aspects of the invention is to provide a liquid ejecting apparatus, which is capable of uniformly maintaining ejection characteristics regardless of a change in temperature while reducing the lowering of a processing function, and a method of controlling the liquid ejecting apparatus.

According to an aspect of the invention, there is provided a liquid ejecting apparatus including: a liquid ejecting head that includes nozzles which eject liquid, a pressure generation section which generates pressure variation in the liquid within a liquid flow channel for communicating with the nozzles, and a temperature detection section, and that ejects the liquid from the nozzles by driving the pressure generation section; a scan section that performs scanning by causing the liquid ejecting head to relatively move on a landing target; and a driving waveform generation section that generates a driving waveform which drives the pressure generation section based on temperature detected by the temperature detection section. A frequency of change in the driving waveform performed by the driving waveform generation section differs between a first temperature range in which a degree of change in viscosity of the liquid is relatively large and a second temperature range in which the degree of the change in the viscosity of the liquid is relatively small.

In the liquid ejecting apparatus, it is preferable that the frequency of change in the driving waveform in the first temperature range be higher than the frequency of change in the driving waveform in the second temperature range.

According to the aspect of the invention, in a range of the first temperature range in which a degree of the change in the viscosity of the liquid is relatively high, variation in the driving waveform occurs at a relatively high frequency, and thus it is possible to perform a liquid ejection process using the most suitable driving waveform in response to the rapid change in the viscosity of the liquid. Therefore, variation in the concentration of a landing pattern of an image or the like, which is formed using the liquid ejection process, is suppressed. In contrast, in a range of the second temperature range in which the degree of the change in the viscosity of the liquid is relatively low, a frequency of execution of the variation in the driving waveform is low compared to a case of the first temperature range, and thus the lowering of the processing function of the liquid ejecting apparatus is suppressed. As a result, it is possible to suppress the lowering of the speed (throughput) of the entire liquid ejection process.

In the liquid ejecting apparatus, the driving waveform generation section may use a configuration in which a driving voltage of the driving waveform is changed based on the temperature detected by the temperature detection section.

In addition, in the liquid ejecting apparatus, the driving waveform generation section may use a configuration in which widths of some waveform elements, which are included in the driving waveform, are changed based on the temperature detected by the temperature detection section.

In addition, according to the aspect of the invention, it is preferable that the change in the viscosity of the liquid be equal to or higher than 0.1 mPa·s/° C. under an environment which is equal to or higher than 10° C.

In addition, according to another aspect of the invention, there is provided a method of controlling the liquid ejecting apparatus which includes a liquid ejecting head that includes nozzles which eject liquid, a pressure generation section which generates pressure variation in the liquid within a liquid flow channel for communicating with the nozzles, and a temperature detection section, and that ejects the liquid from the nozzles by driving the pressure generation section; a scan section that performs scanning by causing the liquid ejecting head to relatively move on a landing target; and a driving waveform generation section that generates a driving waveform which drives the pressure generation section based on temperature detected by the temperature detection section. A frequency of change in the driving waveform performed by the driving waveform generation section differs between a first temperature range in which a degree of change in viscosity of the liquid is relatively large and a second temperature range in which the degree of the change in the viscosity of the liquid is relatively small.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings. Meanwhile, in the embodiment which will be described below, various limitations are made as detailed preferable examples of the invention. However, the scope of the invention is not limited to such aspects unless a gist which particularly limits the invention is described in the description below. In addition, hereinafter, an ink jet type recording apparatus (hereinafter, printer) will be described as an example of a liquid ejecting apparatus of the invention.

Figure 1:
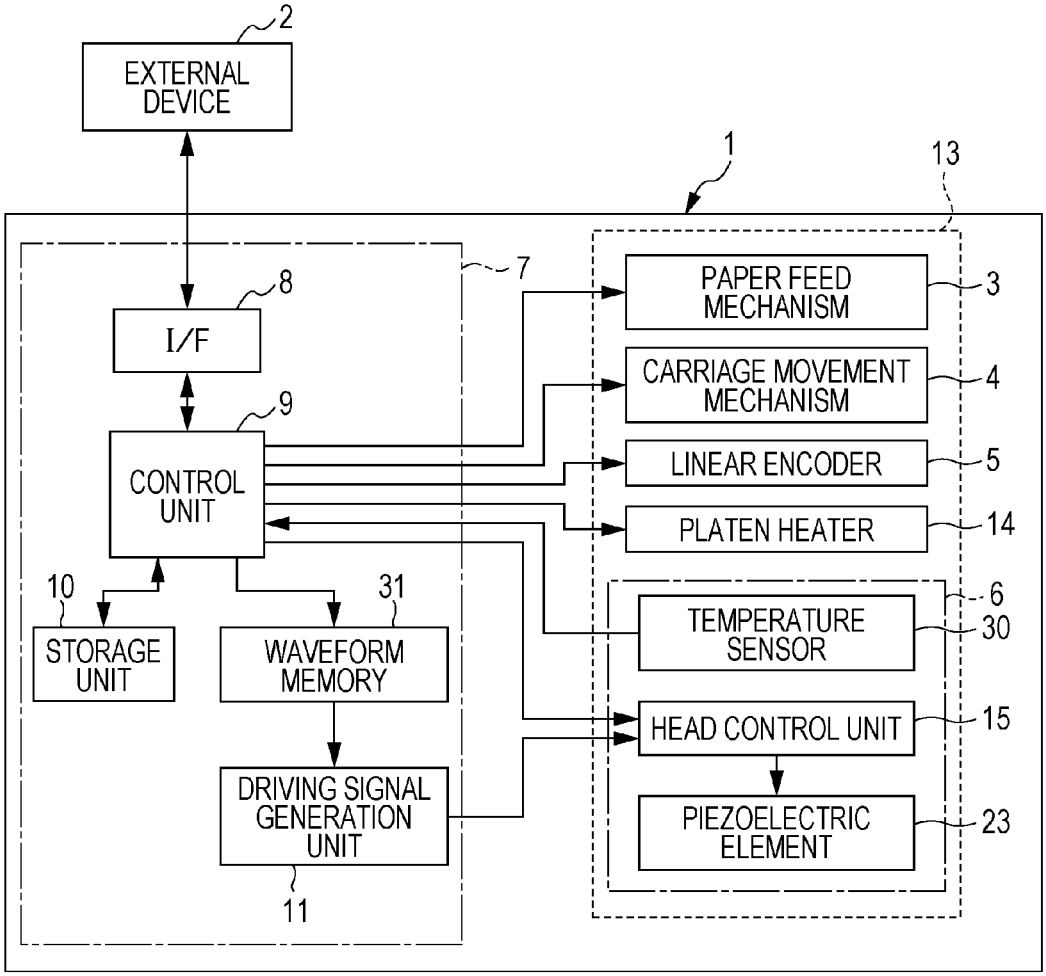
FIG. 1 is a block diagram illustrating the electrical configuration of a printer.
Figure 2:
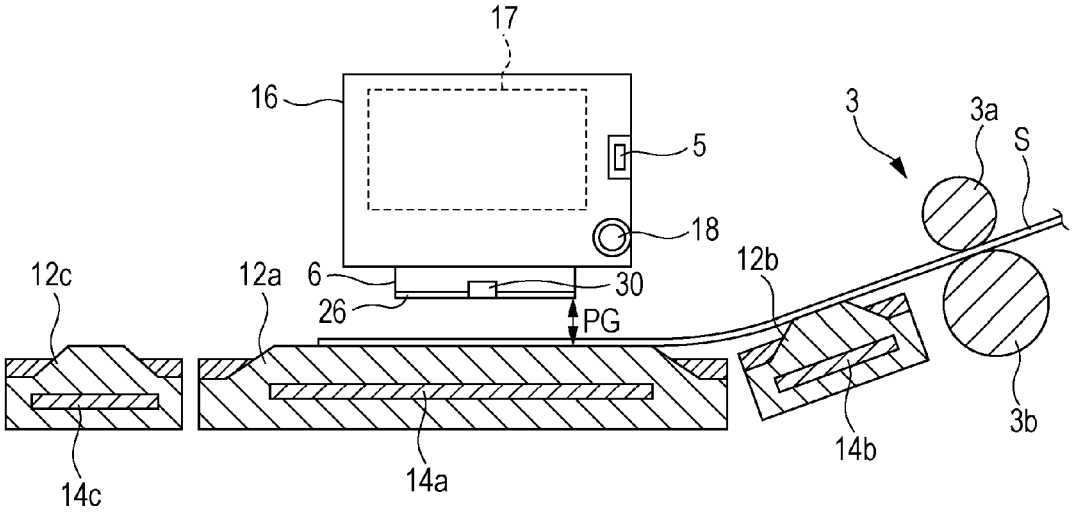
FIG. 2 is a side view illustrating the internal configuration of the printer.

FIG. 1 is a block diagram illustrating the electrical configuration of a printer 1, and FIG. 2 is a schematic diagram illustrating the internal configuration of the printer 1. An external device 2 is, for example, electronic equipment, such as a computer, a digital camera, a mobile phone, or a mobile information terminal device. The external device 2 is electrically connected to the printer 1 in a wireless or wired manner, and causes an image or text to be printed on a resin film or the like, which will be described later, by the printer 1. Therefore, the external device 2 transmits print data to the printer 1 according to the image or the like.

The printer 1 according to the embodiment includes a printer controller 7 and a print engine 13. A recording head 6, which is one kind of a liquid ejecting head, is attached on the bottom surface side of a carriage 16 on which an ink cartridge 17 (liquid supply source) is mounted. Further, the carriage 16 is configured to be capable of reciprocating along a guide rod 18 using a carriage movement mechanism 4 (corresponding to a scan section according to the invention). That is, the printer 1 sequentially transports a recording medium S (one kind of a landing target), such as a resin film or tarpaulin, on a platen 12 using a paper feed mechanism 3, relatively moves the recording head 6 in the width direction (main scan direction) of the recording medium S, ejects ink which is one kind of liquid from nozzles 24 (refer to FIG. 3) of the recording head 6, and causes the ink to land on the recording medium S, thereby recording (forming) an image, text, or the like (ink landing pattern). Meanwhile, it is possible to use a configuration in which the ink cartridge 17 is disposed on the side of a main body of the printer and ink of the ink cartridge 17 is sent to the side of the recording head 6 through a supply tube.

Ink, which includes thermoplastic resin particles, (hereinafter, appropriately abbreviated to resin ink) is used as ink according to the embodiment. The resin ink is used to record an image on the recording medium S that includes a landing surface which does not easily absorb ink. That is, the printer 1 according to the embodiment includes a configuration that promotes the resin ink, which lands on the recording medium S, to be dried and to be fixed by heating the recording medium S using a platen heater 14 which is provided in the platen 12 which will be described later. Further, when the resin ink dries, a resin film is formed to cover a pigment (colorant) on the recording medium S. With regard to the resin ink, change in viscosity with regard to temperature is equal to or higher than 0.1 [mPa·s/° C.] under an environment which is equal to or higher than 10° C. The change in the viscosity for the temperature of ink and ink ejection control based thereon will be described later in detail.

The platen 12 (one kind of a support member) of the printer 1 according to the embodiment is divided into three portions which are independent from each other in the transport direction (sub-scan direction) of the recording medium S. More specifically, the platen 12 is configured to include a main platen 12*a* which is disposed in a position opposite to the nozzle formation surface of the recording head 6 when ink is ejected to the recording medium S, an upstream-side platen 12*b* which is disposed on the upstream-side (paper feeding side) of the sub-scan direction compared to the main platen 12*a*, and a downstream-side platen 12*c* which is disposed on the downstream-side (paper ejecting side) of the sub-scan direction compared to the main platen 12*a*. Further, the platen heater 14 is provided inside of each of the platens 12 as a heater. More specifically, a main heater 14*a* is provided inside of the main platen 12*a*, a pre-heater 14*b* is provided inside of the upstream-side platen 12*b*, and an after heater (post heater) 14*c* is provided inside of the downstream-side platen 12*c*, respectively. The heaters 14*a* to 14*c* are heaters that promote ink which lands on the recording medium S to be fixed and dried by heating the recording medium S. Temperature can be individually set for each of the heaters 14*a* to 14*c* according to the kind of the recording medium S, a recording mode, and the like.

The printer controller 7 is a control unit which controls each of the units of the printer. The printer controller 7 according to the embodiment includes an interface (I/F) unit 8, a control unit 9, a storage unit 10, and a driving signal generation unit 11. The interface unit 8 transmits and receives the state data of the printer when the interface unit 8 transmits print data or a print command from the external device 2 to the printer 1 or the interface unit 8 outputs the state information of the printer 1 to the side of the external device 2. The control unit 9 is an arithmetic processing unit which controls the whole printer. The storage unit 10 is an element which stores the program of the control unit 9 or data used for various types of control, and includes a ROM, a RAM, and a NVRAM (non-volatile memory element). The control unit 9 controls each of the units according to a program which is stored in the storage unit 10. In addition, the control unit 9 according to the embodiment generates ejection data which indicates nozzles 24 and timing that ink is ejected in a case of a recording operation based on the print data from the external device 2, and transmits the ejection data to the head control unit 15 of the recording head 6. Further, the control unit 9 according to the embodiment generates the correction data (correction type) of a driving pulse, which is generated by the driving signal generation unit 11, according to the temperature detected by a temperature sensor 30 which is provided in the recording head 6. The details thereof will be described later.

The driving signal generation unit 11 is a portion which functions as a driving voltage waveform generation section according to the invention, and generates a voltage signal based on waveform data related to the waveform of the driving signal. In addition, the driving signal generation unit 11 amplifies the voltage signal and generates a driving signal COM. The driving signal generation unit 11 according to the embodiment generates, for example, a driving signal COM which includes at least one ejection pulse DP shown in FIGS. 4A and 4B. Here, the ejection pulse DP (one kind of a driving waveform) is a voltage waveform that causes the piezoelectric element 23, which ejects droplet-shaped ink from the recording head 6, to perform a predetermined operation. A waveform (basic waveform) which is reference is set for the ejection pulse DP, and the ejection pulse DP of the basic waveform is assumed to be used under an environment of the reference temperature (for example, 35° C.).

In the embodiment, a waveform memory 31 is provided in the fore stage of the driving signal generation unit 11. The waveform memory 31 is a waveform data storage section that stores waveform data which is generated by the control unit 9. Meanwhile, the driving signal generation unit 11 includes an internal memory which separately stores the waveform data from the waveform memory 31. The internal memory stores the waveform data of the driving signal (ejection pulse) which is actually used in the printing process. In contrast, the waveform memory 31 stores the waveform data of the driving signal (ejection pulse DP) which is actually used in the printing process, and separately stores waveform data (data for correction) which is used after the waveform data of the driving signal is used. That is, the waveform memory 31 functions as a buffer for the internal memory of the driving signal generation unit 11.

Subsequently, the print engine 13 will be described. The print engine 13 includes a paper feed mechanism 3, a carriage movement mechanism 4, a linear encoder 5, a platen heater 14, a recording head 6, and the like, as shown in FIG. 1. The carriage movement mechanism 4 includes a carriage 16, to which the recording head 6 that is one kind of the liquid ejecting head is attached, a driving motor (for example, DC motor (not shown in the drawing)), which causes the carriage 16 to travel through a timing belt and the like, and the like. Further, the carriage movement mechanism 4 moves the recording head 6, which is mounted on the carriage 16, in the main scan direction. The paper feed mechanism 3 includes a paper feed motor (not shown in the drawing), paper feed rollers 3*a* and 3*b*, and the like, and performs sub-scan by sequentially sending the recording medium S on the platen 12. In addition, the linear encoder 5 outputs an encoder pulse according to the scan position of the recording head 6, which is mounted on the carriage 16, to the printer controller 7 as positional information in the main scan direction. The printer controller 7 can recognize the scan position (current position) of the recording head 6 based on the encoder pulse which is received from the side of the linear encoder 5.

Subsequently, the recording head 6 will be described.

Figure 3:
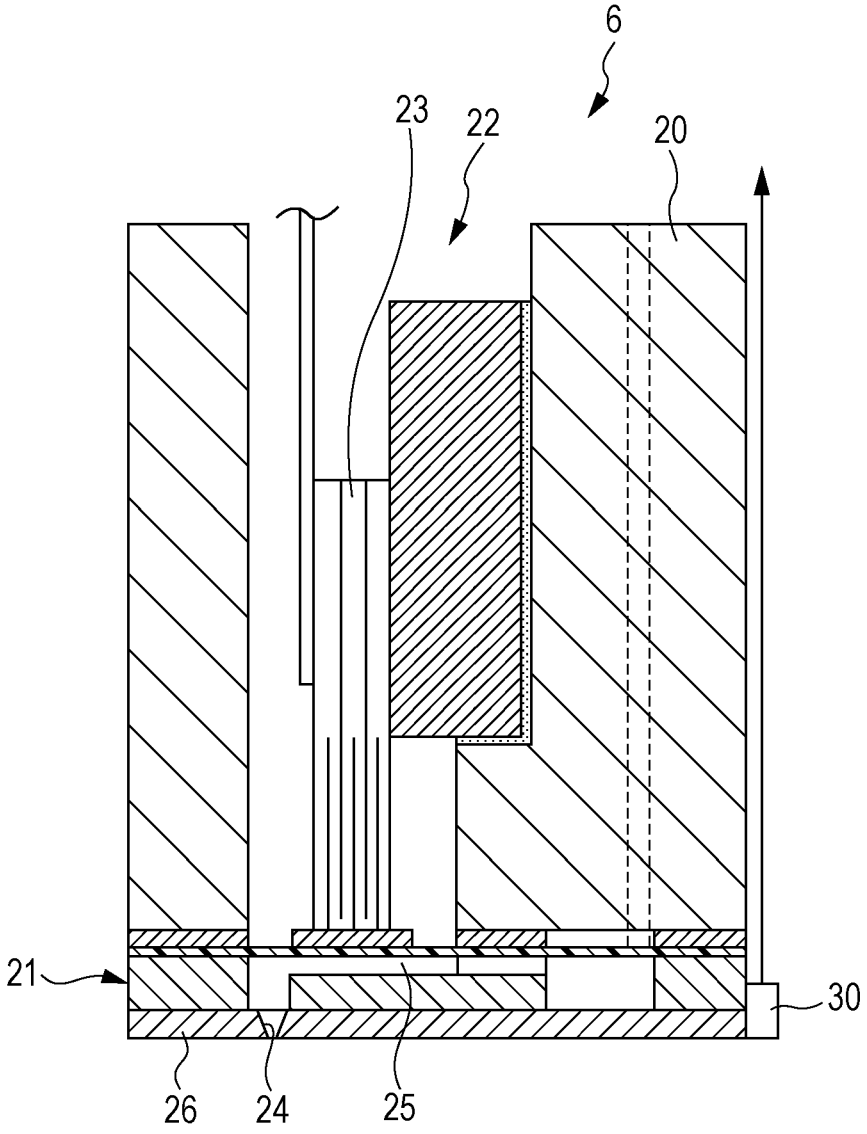
FIG. 3 is a cross-sectional view illustrating the configuration of a recording head.

As shown in FIG. 3, the recording head 6 is schematically configured to include a case 20, a flow channel unit 21, and a vibrator unit 22. The vibrator unit 22, which is accommodated in the internal space of the case 20, includes a plurality of piezoelectric elements 23, which function as a pressure generation section, for the respective nozzles 24. The piezoelectric elements 23 are so-called vertical vibration-type piezoelectric elements which expand and contract in the direction perpendicular to the electric field direction. The tip portions of the piezoelectric elements 23 are connected to a flexible operating surface of the flow channel unit 21 which performs division on a part of the pressure chamber 25. An ink flow channel (corresponding to a liquid flow channel according to the invention) is formed inside of the flow channel unit 21, and the pressure chamber 25 which is included in a part of the ink flow channel is formed for each nozzle 24. A nozzle plate 26 (nozzle forming member), in which a plurality of rows of nozzles 24 are arranged, is provided at the bottom (surface which is opposite to the recording medium S or the main platen 12*a*) of the flow channel unit 21. The nozzle plate 26 is formed of, for example, a metallic plate such as stainless steel. Further, the recording head 6 according to the embodiment is configured such that, when the piezoelectric elements 23 are expanded and contracted according to the waveform of the driving voltage by applying the driving voltage to the piezoelectric elements 23, the volume of the pressure chamber 25 changes, and thus pressure variation is generated in ink within the pressure chamber 25. Further, ink is ejected from the nozzles 24 using the pressure variation.

Configuration is made such that ink (resin ink) which is stored in the ink cartridge 17 mounted on the carriage 16 is supplied to the recording head 6. The temperature sensor 30 is provided on the side surface of the recording head 6 according to the embodiment in a state in which the temperature sensor 30 is adjacent to the nozzle plate 26. The temperature sensor 30 is configured to include a thermistor, an A/D converter, or the like. The temperature sensor 30 functions as a temperature detection section according to the invention, detects environmental temperature around the recording head 6, in particular, in the vicinity of the nozzle plate 26, and outputs a signal, which has a size proportional to the detected temperature, to the printer controller 7.

Figure 4A:
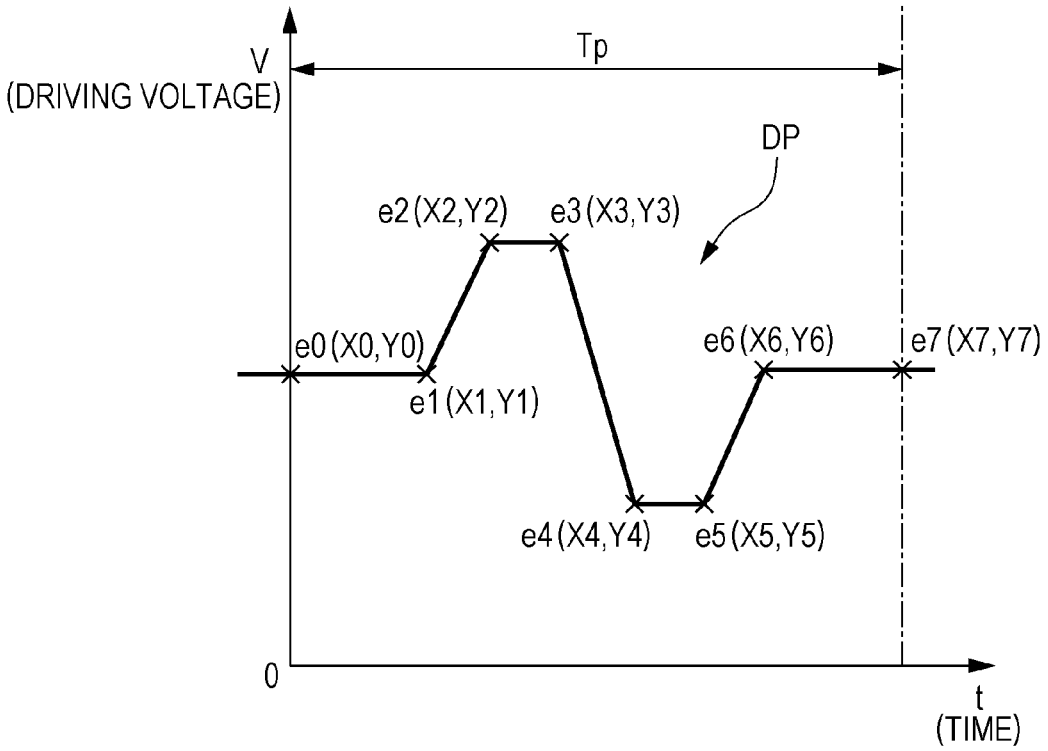
FIGS. 4A and 4B are waveform charts illustrating the configurations of driving pulses.
Figure 4B:
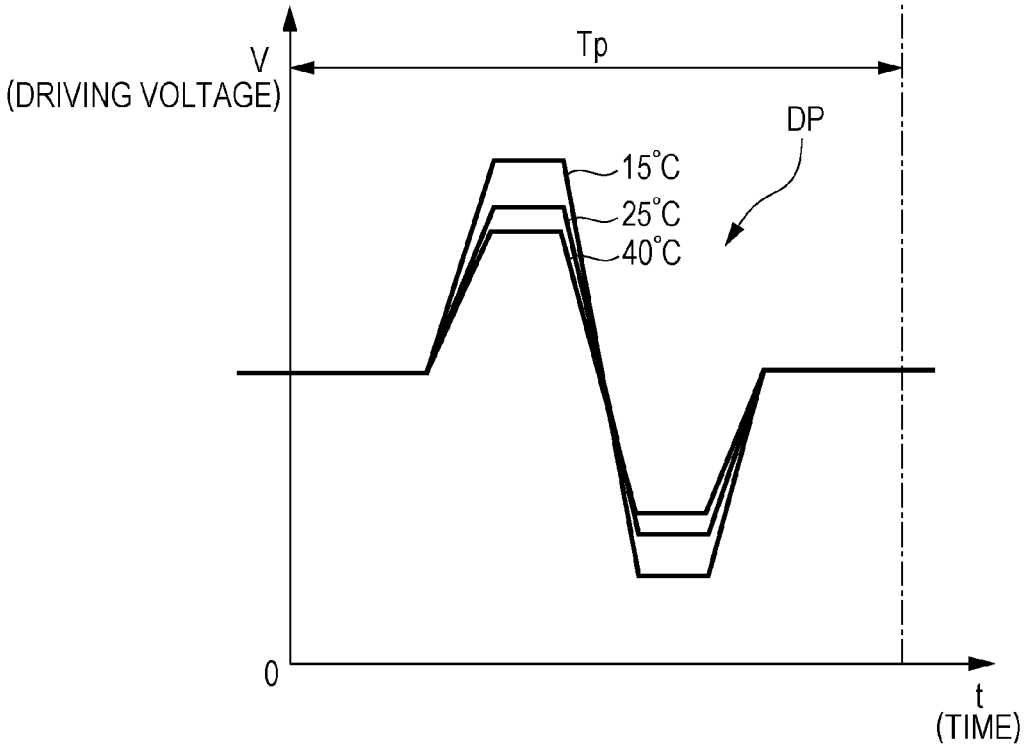

FIGS. 4A and 4B are waveform charts illustrating the configurations of the ejection pulses DP included in the driving signal COM which is generated by the driving signal generation unit 11. The driving signal COM is repeatedly generated from the driving signal generation unit 11 for every unit period which is a repetition period. The unit period corresponds to a period during which the nozzles 24 move by a distance corresponding to one pixel of an image or the like to be printed on the recording medium S. For example, when print resolution is 720 dpi, the unit period T corresponds to a period in which the nozzles 24 move on the recording medium S by 1/720 inches. Further, the unit period includes at least one period Tp in which the ejection pulses DP are generated. That is, the driving signal COM includes at least one ejection pulse DP. Meanwhile, the shape of the ejection pulse DP is not limited to the above examples, and various types of waveforms may be used according to the amount of ink which is ejected from the nozzles 24.

In FIG. 4A, coordinates e0 to e7 are shown at the respective points of the waveform of the ejection pulse DP. When the driving signal COM is generated, coordinate data which defines (time, voltage) with respect to the waveform of such a driving signal is transmitted from the control unit 9 to the waveform memory 31. That is, X of the coordinate data indicates time (elapse time) when e0 is set to an original point (base point), and Y indicates a voltage (potential) at the time. The driving signal generation unit 11 interpolates between the coordinates based on the coordinate data (waveform data) of the waveform memory 31, and generates and changes the driving signal having the waveform acquired by putting the coordinates of each coordinate data together. That is, when each of the coordinate data, which is the waveform data, is set in the waveform memory 31, the waveform of the ejection pulse DP is output according to the coordinate data.

For example, when increase in the amplitude of the ejection pulse is desired, the values of a voltage Y2 at e2 and a voltage Y3 at e3 are increased and the values of a voltage Y4 at e4 and a voltage Y5 at e5 are decreased. In this way, the amplitude of the ejection pulse increases, and thus the applied potential of the piezoelectric element 23 is further increased. In addition, when decrease in the amplitude of the ejection pulse is desired, the values of the voltage Y2 at e2 and the voltage Y3 at e3 are decreased and the values of the voltage Y4 at e4 and the voltage Y5 at e5 are increased. In this way, since the amplitude of the ejection pulse decreases, the displacement of the applied piezoelectric element 23 is further decreased. Further, it is possible to generate a desired ejection pulse. In addition, it is possible to change the inclination of the change in the potential without changing the voltage. For example, it is possible to cause the inclination of the change in the potential to be sharp by increasing the value of a time X1 at e1 or decreasing the value of a time X4 at e4. Therefore, the displacement of the applied piezoelectric element 23 becomes further sharp. In contrast, it is possible to cause the inclination of the change in the potential to be smooth by decreasing the value of the time X1 at e1 or increasing the value of the time X4 at e4. Therefore, the displacement of the applied piezoelectric element 23 becomes further smooth.

However, it is assumed that the ejection pulse DP having the basic waveform is used under an environment of the reference temperature (for example, 35° C.). However, for example, immediately after power is supplied to the printer 1, there is a case in which the temperature of ink of the recording head 6 is lower than the reference temperature. In addition, there is a case in which ink is heated by heat of the platen heater 14 or the like as time elapses, and thus the temperature of ink gradually rises and becomes higher than the reference temperature. When the temperature is relatively low, the viscosity of ink rises. When the temperature is relatively high, the viscosity of ink is lowered. In such a case, when ink is ejected by driving the piezoelectric element 23 using the ejection pulse DP which usually has a basic waveform, the amount of ejection of ink changes. More specifically, under an environment in which temperature is lower than the reference temperature, the amount and flight speed of ink which is ejected from the nozzles 24 are decreased when ink is ejected by applying the ejection pulse DP having a basic waveform to the piezoelectric element 23. In addition, under an environment in which temperature is higher than the reference temperature, the amount and flight speed of ink which is ejected from the nozzles 24 are increased. More specifically, since ink (resin ink) used in the embodiment has a tendency that the viscosity thereof easily changes due to temperature, ejection characteristics easily change due to the change in temperature. As a result, the concentration of an image which is formed on the recording medium S changes according to temperature. Therefore, in the printer 1 according to the embodiment, a correction formula for the ejection pulse DP is generated according to the temperature which is detected by the temperature sensor 30, and the driving signal (driving pulse DP) which is generated by the driving signal generation unit 11 changes based on the correction formula.

Figure 5:
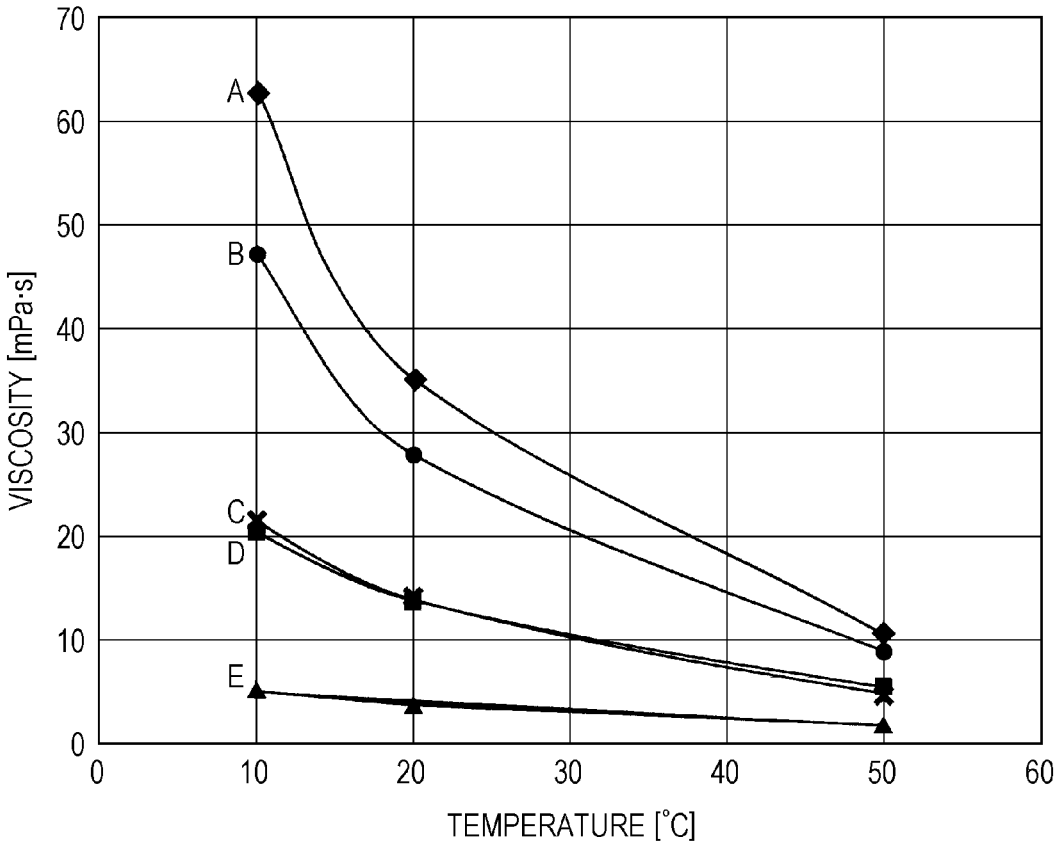
FIG. 5 is a graph illustrating change in the viscosity of ink with regard to change in temperature.

FIG. 5 is a graph illustrating the change in the viscosity of ink for environmental temperature (temperature which is detected by the temperature sensor 30). In the drawing, the characteristics of the changes in viscosities of the total of five kinds of ink A to E are illustrated. As shown in the drawing, each of the ink has a tendency that the viscosity thereof decreases as temperature rises. The degrees of the changes in the viscosities differ from each other according to the kind (composition) of ink. In ink (for example, ink E) which includes small amount of solid component included in dye ink and the other ink, a ratio of change in the viscosity to temperature is relatively low. In contrast, in ink which includes a color material (pigment) having a relatively large particle diameter, ink (ink A to D) which includes the relatively large amount of solid component such as resin, or the like, the ratio of change in the viscosity to temperature is relatively high according to the particle diameter of the color material and the resin content. Further, as shown in the drawing, more specifically, in a relatively low temperature range (corresponding to a first temperature range according to the invention) of 10 to 20° C., the ratio of change in the viscosity is high compared to a temperature range (a second temperature range according to the invention) which is higher than 20° C. As above, since the viscosity of ink significantly changes in the first temperature range, the ink ejection characteristics of ink are easily changed, and thus a problem, such as change in concentration of a record image, easily occurs. From the viewpoint of suppressing the change in ejection characteristics, it is desirable to increase the frequency of temperature detection and driving signal (ejection pulse DP) change. However, if the temperature detection and the driving pulse change are frequently performed during the printing process (process to eject ink to the recording medium S), the processing capability of the control unit 9 of the printer is caused to be lowered. As a result, there is a problem in that the entire throughput of the printing process of the printer 1 is lowered.

Considering such a situation, in the printer 1 according to the embodiment, the frequency of change in the driving signal (driving pulse) of the driving signal generation unit 11 is configured to differ between the first temperature range in which the degree of the change in the viscosity of ink is relatively large and the second temperature range in which the degree of the change in the viscosity of ink is relatively small. More specifically, setting is made such that the frequency of change in the driving pulse in the first temperature range is higher than the frequency of change in the driving pulse in the second temperature range. Hereinafter, description will be made more specifically in this regard.

The control unit 9 according to the invention detects temperature in the vicinity of the recording head 6 using the temperature sensor 30 while the recording head 6 moves (performs scanning) in the print area (a recording area or an ejection area) which is an area where an image or the like is printed on the recording medium S, and corrects the ejection pulse DP which is included in the driving signal COM generated from the driving signal generation unit 11 according to the detected temperature. More specifically, a formula for correcting the ejection pulse DP is generated. Meanwhile, the print area (recording area or eject area) according to the embodiment expresses a portion of an area corresponding to the width of the recording medium S (the dimension of a direction perpendicular to the transport direction) in which an image or the like is actually recorded, and means an area which is the inside between a position to which ink is initially ejected and then lands when scanning (passing) is performed one time by the recording head 6 and a position to which ink is finally ejected and lands. However, in the drawing, for convenience, an area in which the recording head 6 generally moves at a constant speed is assumed as the print area, and an area in which the recording head 6 accelerates or decelerates is assumed as the outside of the print area.

Figure 6:
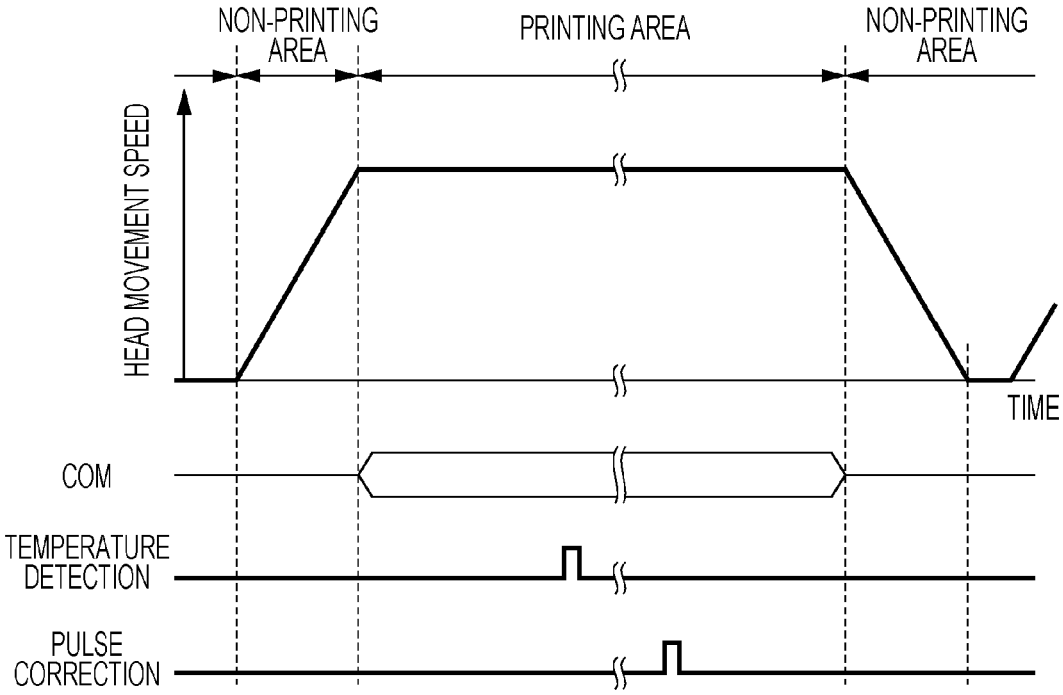
FIG. 6 is a timing chart illustrating timings of respective processes of driving signal generation, temperature detection, and pulse correction.

FIG. 6 is a timing chart illustrating timings of the respective processes of the generation of the driving signal COM, the temperature detection, and the pulse correction in response to the movement speed of the recording head 6, and illustrates the one-way scanning performed by the recording head 6. Meanwhile, the timings of the temperature detection and the pulse correction are illustrated using rectangular pulses.

When the printer controller 7 receives a print command and starts the printing process, temperature at a time point of printing process starts is first detected by the temperature sensor 30. The basic waveform of the ejection pulse DP is appropriately corrected according to the detected temperature. In addition, a subsequent timing (or frequency of execution) at which the ejection pulse DP is changed) is determined according to whether the detected temperature is included in the first temperature range or included in the second temperature range. Description will be made later in this regard.

Subsequently, the recording head 6 which stands by in the home position starts to move toward a side of the full position. Acceleration until the recording head 6 is at the constant speed is completed at the outside of the print area. In the print area, the recording head 6 prints an image or the like on the recording medium S by ejecting ink from the nozzles 24 by applying the ejection pulse DP (when correction is performed, ejection pulse DP is acquired after the correction) included in the driving signal COM to the piezoelectric element 23 based on the print data while the recording head 6 moves at a constant speed. Further, when the recording head 6 moves to the outside of the print area, the recording head 6 stops the eject operation first and then decelerates, and thus the movement speed temporally becomes 0 at a point in time when the movement direction is switched to an opposite direction, that is, movement stops.

In the middle of the printing process, the recording medium S is heated by the platen heater 14, temperature around the recording head 6 rises as time elapses. Accordingly, the temperature of ink inside of the recording head 6 gradually rises, and thus the viscosity of ink changes. Even when the viscosity of ink changes, the ejection characteristics should be maintained constantly, and thus the ejection pulse DP is corrected by the control unit 9 based on the temperature detected by the temperature sensor 30 in the middle of the printing process. Further, as described above, according to whether the temperature detected by the temperature sensor 30 is included in the first temperature range in which the degree of the change in the viscosity of ink for the change in temperature is relatively high or in the second temperature range in which the degree of the change in the viscosity of ink for the change in temperature is relatively stable, the timing at which the ejection pulse DP correction and the driving signal change based on the correction are subsequently performed, that is, a frequency of execution differs. More specifically, in a range in which the detected temperature is included in the first temperature range, the correction is performed whenever, for example, the recording head 6 performs scanning (passing). In addition, in a range in which the detected temperature is included in the second temperature range, the correction is performed whenever, for example, the recording head 6 performs scanning at a plurality of times or the printing process (a bundle of print job based on predetermined print data) is performed. That is, in the first temperature range, the frequency of the change in driving signal is high compared to the second temperature range.

In the embodiment, the temperature detection and the correction of the waveform of the ejection pulse DP are performed by the temperature sensor 30 while the scanning is performed in the print area. With the temperature detection performed by the temperature sensor 30, the ejection pulse DP correction is performed according to the detected temperature. When the temperature is detected by the temperature sensor 30, the control unit 9 generates a correction formula for defining the amount of change in the coordinates e0 to e7 at the respective points of the waveform elements included in the ejection pulse DP based on the detected temperature, and stores data of the correction formula in the waveform memory 31. That is, an ejection pulse DP which is generated by the driving signal generation unit 11 in the subsequent printing process (after the subsequent pass) is changed based on the detected temperature and the correction formula.

FIG. 4B is a graph illustrating the ejection pulse DP which is corrected according to temperature detected by the temperature sensor 30. In the drawing, ejection pulses DP, which are respectively generated in a case in which the detected temperature is 15° C., in a case in which the detected temperature is 25° C., and in a case in which the detected temperature is 40° C., are shown. Here, a use temperature range assumed in the printer 1 is included in, for example, 5° C. to 45° C. As shown in the drawing, setting is made such that the amplitude of the ejection pulse DP in a case of the second temperature range (25° C.), in which the temperature is relatively high, is smaller than the amplitude of the ejection pulse DP in a case of the first temperature range (15° C.), in which the temperature is relatively low (driving voltage Vd which is a potential difference from the lowest potential to the highest potential). In addition, in the same manner, setting is made such that the amplitude of the ejection pulse DP in a case of temperature (40° C.) which is higher in the second temperature range is further small. In the resin ink, when temperature is high in the use temperature range, the viscosity thereof becomes small, and thus correction is performed such that the amplitude of the ejection pulse DP is small according thereto. That is, the control unit 9 which functions as the correction section performs correction such that the driving voltage of the ejection pulse DP is lowered as the temperature detected by the temperature sensor 30 is high. Further, the driving signal generation unit 11 generates the driving signal COM, in which the ejection pulse DP is changed based on the correction formula, until subsequent change in correction is performed.

As above, in the range of the first temperature range in which the degree of the change in the viscosity of ink is relatively high, the ejection pulse is changed with a relatively high frequency, and thus it is possible to perform the printing process using a more-optimized ejection driving pulse DP in response to the rapid change in the viscosity of ink. Therefore, variation in the concentration of an image or the like which is printed on the recording medium S is suppressed. In contrast, in the range of the second temperature range in which the degree of the change in the viscosity of ink is relatively low, the frequency of execution of the temperature detection and the ejection pulse change is reduced compared to the first temperature range. Accordingly, the lowering of the processing function of the control unit 9 is suppressed. As a result, it is possible to suppress the lowering of the speed (throughput) of the entire printing process. In the embodiment, since the temperature detection and the ejection pulse correction (correction formula creation) are performed in the print area, it is possible to correspond to the more remarkable change in temperature, and it is possible to perform more effective suppression of the change in ejection characteristics in accordance with the change in temperature.

Meanwhile, the invention is not limited to the each embodiment, and various modifications are possible based on the claims.

Figure 7A:
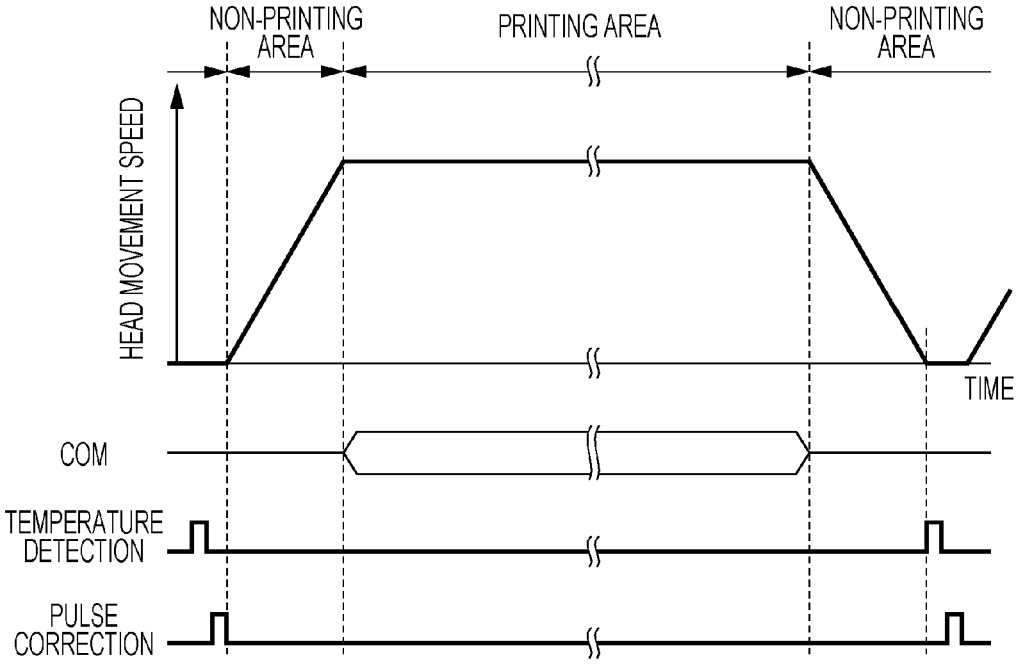
FIGS. 7A and 7B are timing charts illustrating timings of temperature detection and pulse correction according to another embodiment.

FIG. 7A is a timing chart illustrating timings of the temperature detection and the ejection pulse correction according to a second embodiment of the invention. In the first embodiment, the configuration, in which the recording head 6 performs the temperature detection or the like while performing scanning in the print area, has been illustrated. However, in the embodiment, the temperature detection and the ejection pulse correction are performed at the outside of the print area at a point in time when the recording head 6 stops moving. If the temperature detection is performed at the timing at which the recording head 6 stops moving, noise is prevented from being superimposed on a detection signal. Therefore, it is possible to reduce the misdetection of temperature. Meanwhile, as noise which is superimposed on the detection signal of the temperature sensor 9, noise which is accompanied by vibration generated when the recording head 6 moves or noise generated from a motor of the movement mechanism 3 for the cartridge may be considered. Therefore, if the temperature detection is performed at the point in time when the recording head 6 stops moving, it is possible to prevent the influence thereof. In addition, if the temperature detection or the like is performed at the outside of the print area, it is possible to suppress the lowering of the processing function of the printing process. The other configurations or the like are the same as in the first embodiment, and thus the description thereof will not be repeated.

Figure 7B:
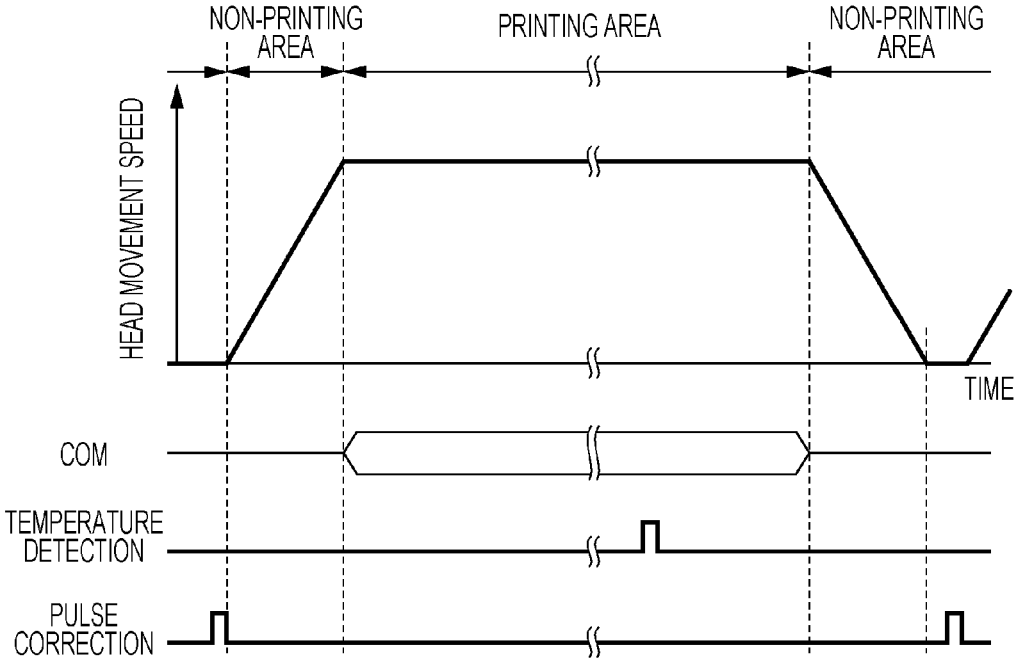
Figure 8:
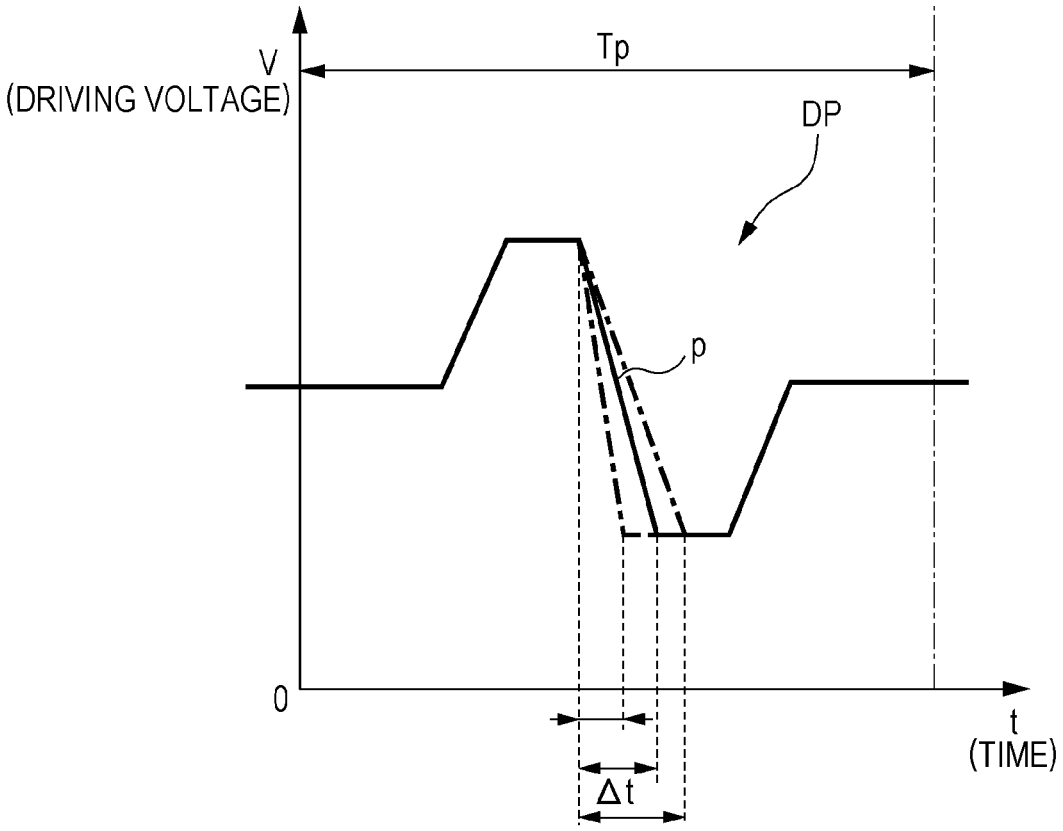
FIG. 8 is a waveform chart illustrating driving pulse correction and modification according to the other embodiment.

In addition, FIG. 7B is a timing chart illustrating timings of the temperature detection and the ejection pulse correction according to a third embodiment of the invention. In the embodiment, the temperature detection is performed in the print area. In contrast, the ejection pulse correction is performed at the outside of the print area and at a point of time that the recording head 6 stops moving. According to the embodiment, it is possible to suppress the lowering of the processing function of the printing process and to detect actual temperature during the printing process, and thus it is possible to perform more appropriate correction. The other configurations or the like are the same as in the first embodiment, and thus the description thereof will not be repeated.

Further, in the first embodiment, the configuration in which the amplitude (driving voltage Vd) of the ejection pulse DP is corrected based on the detected temperature has been illustrated. However, the invention is not limited thereto. For example, it is possible to use a configuration in which the widths (time widths) of some waveform elements which are included in the ejection pulse DP are corrected. More specifically, for example, it is possible to change the width of the waveform element p (time $\Delta t$), which drives the piezoelectric element 23 so as to contract the pressure chamber 25 which ejects ink from the nozzles 24, according to the detected temperature. If the width of the waveform element p is relatively short, the inclination (rate of change in potential) of the waveform element p is large. Accordingly, the amount of ink which is ejected from the nozzles 24 and the flight speed are increased. In addition, if the width of the waveform element p is relatively long, the inclination (rate of change in potential) of the waveform element p is small, and thus the amount of ink which is ejected from the nozzles 24 and the flight speed are decreased. Therefore, when the detected temperature is relatively low, correction is performed such that the width of the waveform element p is relatively short. In contrast, when the detected temperature is relatively high, correction is performed such that the width of the waveform element p is relatively long. Therefore, as the same as in the first embodiment, it is possible to uniformly align the ejection characteristics regardless of the change in temperature. In brief, correction may be performed to acquire the ejection pulse DP such that the target ejection characteristics can be acquired regardless of temperature, and it is possible to use various types of well-known correction methods.

In addition, in the embodiment, resin ink which includes thermoplastic resin particles is illustrated as liquid according to the invention. However, the invention is not limited thereto. Further, the invention is suitable for a configuration in which liquid in which the ratio of the change in the viscosity to the change in temperature is relatively high, more specifically, liquid in which the change in the viscosity is equal to or higher than 0.1 [mPa·s/° C.] under an environment which is equal to or higher than 10° C., for example, ultraviolet ray curable ink, which hardens when ultraviolet rays are irradiated, is ejected.

Further, in the embodiment, although the platen heater 14 is illustrated as the heater, the invention is not limited thereto. The invention is suitable for a configuration in which a head heater that heats ink in the recording head 6, and infrared heater that heats the recording medium S from the upper side, and the like are included.

Meanwhile, in the embodiment, although the so-called vertical vibration-type piezoelectric element 23 is illustrated as a pressure generation section, the invention is not limited thereto. For example, it is possible to use a so-called deflection oscillation-type piezoelectric element. In this case, the driving pulse DP which is illustrated in the embodiment is the waveform in which the potential change direction, that is, the up and down direction, are reversed.

In addition, the pressure generation section is not limited to the piezoelectric element, and it is possible to apply the invention to a case in which various types of pressure generation sections, such as a heating element which generates bubbles in the pressure chamber and an electrostatic actuator which varies the volume of the pressure chamber using electrostatic force, are used.

Further, if the liquid ejecting apparatus ejects liquid which has a relatively high degree of the change in the viscosity for the change in temperature, the invention is not limited to the printer. Further, it is possible to apply the invention to various types of ink jet type recording apparatuses, such as a plotter, a facsimile device and a copy machine, or printing equipment which performs printing by landing ink on a fabric (material to be printed), which is one kind of the landing target, from liquid ejecting heads.

What is claimed is:

1. A liquid ejecting apparatus comprising:

a liquid ejecting head that comprises nozzles which eject liquid, a pressure generation section which generates pressure variation in the liquid within a liquid flow channel for communicating with the nozzles, and a temperature detection section, and that ejects the liquid from the nozzles by driving the pressure generation section;

a scan section that performs scanning by causing the liquid ejecting head to relatively move with respect to a landing target back and forth between a printing area in which the liquid ejecting head relatively moves on the landing target, and a non-printing area in which the liquid ejecting head is not on the landing target; and a driving waveform generation section that generates a driving waveform which drives the pressure generation section based on temperature detected by the temperature detection section, wherein the temperature detection section detects the temperature while the liquid ejecting head is in the printing area, and wherein a change in the driving waveform is performed by the driving waveform generation section while the liquid ejecting head is in the non-printing area.

2. The liquid ejecting apparatus according to claim 1, wherein the driving waveform generation section changes a driving voltage of the driving waveform based on the temperature detected by the temperature detection section.

3. The liquid ejecting apparatus according to claim 1, wherein the driving waveform generation section changes widths of some waveform elements, which are included in the driving waveform, based on the temperature detected by the temperature detection section.

4. The liquid ejecting apparatus according to claim 1, wherein the change in the viscosity of the liquid is equal to or higher than 0.1 mPa·s/° C. under an environment which is equal to or higher than 10° C.

5. The liquid ejecting apparatus according to claim 1, wherein a frequency of change in the driving waveform performed by the driving waveform generation section differs between a first temperature range in which a degree of change in viscosity of the liquid is relatively large and a second temperature range in which the degree of the change in the viscosity of the liquid is relatively small.

6. The liquid ejecting apparatus according to claim 5, wherein the frequency of change in the driving waveform in the first temperature range is higher than the frequency of change in the driving waveform in the second temperature range.

7. A method of controlling a liquid ejecting apparatus which comprises a liquid ejecting head that comprises nozzles which eject liquid, a pressure generation section which generates pressure variation in the liquid within a liquid flow channel for communicating with the nozzles, and a temperature detection section, and that ejects the liquid from the nozzles by driving the pressure generation section; a scan section that performs scanning by causing the liquid ejecting head to relatively move with respect to a landing target back and forth between a printing area in which the liquid ejecting head relatively moves on the landing target, and a non-printing area in which the liquid ejecting head is not on the landing target; and a driving waveform generation section, the method comprising:

detecting the temperature with the temperature detection section while the liquid ejecting head is in the printing area;

generating a driving waveform from the driving waveform generation section based on the temperature detected by the temperature detection section;

changing the driving waveform by the driving waveform generation section while the liquid ejecting head is in the non-printing area; and driving the pressure generation section with the driving waveform.

8. The method according to claim 7, wherein a frequency of change in the driving waveform performed by the driving waveform generation section differs between a first temperature range in which a degree of change in viscosity of the liquid is relatively large and a second temperature range in which the degree of the change in the viscosity of the liquid is relatively small.

* * * * *